US009905971B2

(12) United States Patent
Yoon

(10) Patent No.: US 9,905,971 B2
(45) Date of Patent: Feb. 27, 2018

(54) LAMP SOCKET

(71) Applicant: Molex, LLC, Lisle, IL (US)

(72) Inventor: Byung-Chan Yoon, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/126,200

(22) PCT Filed: Mar. 18, 2015

(86) PCT No.: PCT/US2015/021182
§ 371 (c)(1),
(2) Date: Sep. 14, 2016

(87) PCT Pub. No.: WO2015/143002
PCT Pub. Date: Sep. 24, 2015

(65) Prior Publication Data

US 2017/0085046 A1 Mar. 23, 2017

(30) Foreign Application Priority Data

Mar. 20, 2014 (KR) ..... 10-2014-0032990

(51) Int. Cl.

| | |
|---|---|
| ***H01R 13/64*** | (2006.01) |
| ***H01R 33/09*** | (2006.01) |
| ***H01R 33/72*** | (2006.01) |
| ***H01R 33/97*** | (2006.01) |
| ***H01R 33/22*** | (2006.01) |

(52) U.S. Cl.
CPC ..... *H01R 13/64* (2013.01); *H01R 33/09* (2013.01); *H01R 33/22* (2013.01); *H01R 33/72* (2013.01); *H01R 33/97* (2013.01); *Y10S 439/914* (2013.01)

(58) Field of Classification Search
CPC ..... H01R 13/64
See application file for complete search history.

(56) References Cited

U.S. PATENT DOCUMENTS

| | | | | |
|---|---|---|---|---|
| 5,588,860 | A * | 12/1996 | Uchiyama | F21S 48/211 439/336 |
| 5,951,318 | A * | 9/1999 | Harada | H01R 33/09 439/356 |
| 6,376,974 | B1 | 4/2002 | Tsai | |
| 6,607,293 | B2 | 8/2003 | Sanuki et al. | |
| 7,473,024 | B2 * | 1/2009 | Gibboney | F21S 8/00 362/644 |
| 8,632,364 | B2 | 1/2014 | Lee et al. | |
| 2010/0015843 | A1 | 1/2010 | Zayas et al. | |
| 2010/0184336 | A1 | 7/2010 | Yoon et al. | |
| 2017/0085046 | A1 * | 3/2017 | Yoon | H01R 33/72 |

* cited by examiner

*Primary Examiner* — James Harvey
(74) *Attorney, Agent, or Firm* — Clarence R. Moon

(57) ABSTRACT

The disclosure relates to a lamp socket, and more specifically to a lamp socket so configured as to restrict the insertion of bulbs other than the intended bulb, by arranging ribs on the socket housing corresponding to the shape of a key formed on the bulb. The lamp socket of the disclosure is configured so that when the base of a bulb is inserted into the receiving space of the socket housing, the key formed on the base is not interfered with by the ribs arranged in the receiving space, while if the shape of the key does not match the pattern in which the ribs are arranged, the key will be caught on the ribs, preventing the insertion of the base.

20 Claims, 9 Drawing Sheets

LAMP SOCKET

RELATED APPLICATIONS

This application claims priority to Korean Application No. 10-2014-0032990, filed Mar. 20, 2014, which is incorporated herein by reference in its entirety.

TECHNICAL FIELD

The disclosure relates to a lamp socket, and more specifically to a lamp socket configured to restrict the insertion of bulbs other than the intended bulb, by arranging ribs on the socket housing corresponding to the shape of a key formed on the bulb.

BACKGROUND ART

Generally, lamp sockets are both insertion holes for supplying electricity to bulbs, and devices fir supporting bulbs; depending on the manner of mounting the bulb in the socket, they may be Edison-type sockets that are twisted screw fashion or Swan-type sockets that are inserted.

Edison-type sockets are widely used in typical home electric wiring, while Swan-type sockets are used in automobiles and various electric apparatus, etc.

In particular, Swan-type lamp sockets are both complex in structure and precise, their fabrication requires great care, and their fabrication costs are also greater than Edison-type lamp sockets.

An example of a Swan-type socket of the prior art is disclosed in Korean Registered Patent No. 10-08828680 (hereinafter "the prior art reference"), under the name "lamp socket."

The lamp socket of the prior art reference comprises a socket housing in the top receiving space in which a bulb is inserted and fixed in place; it has the advantage of reduced manufacturing costs with the manufacturing process simplified by molding the socket housing with a single mold.

But despite these advantages, according to the lamp socket of the prior art reference, not just one specific bulb but also other bulbs can be inserted into the receiving space of the socket housing, and there is the problem that the bulb can be inserted.

(Patent Reference 0001) Republic of Korea Registered Patent Gazette No, 10-0882868

SUMMARY OF THE INVENTION

The disclosure, which has been devised in order to address the above-described problems of the prior art, is to provide a lamp socket wherein only a specific bulb can be inserted and mounted, and insertion is prevented if the bulb is inserted backwards.

The lamp socket of this disclosure is configured so that upon insertion of the base of a bulb into the receiving space of the socket housing, the key formed on the base is not interfered with by the ribs arranged in the receiving space and if the shape of the key does not match the pattern in which the ribs are arranged, the key will be caught on the ribs, preventing the insertion of the base.

A key groove, into which the key is inserted, is formed on the inner wall of the receiving space by the arrangement of the ribs and on either side within the receiving space, elastic lamp holders are fixed that adhere to the base and hold it in place. A key is formed on one side or both sides of the base; corresponding thereto, ribs are arranged to form key groove (s) on the inner wall of the receiving space.

On either side of the inner wall of the receiving space, holder fixing grooves are respectively formed into which a lamp holder is inserted; on the lamp holder, an inner wall support is furnished that supports the inner wall of the receiving space to prevent it from being pushed outward when the base of a bulb is inserted into the receiving space. The lamp holder comprises: a housing fixing part fixed to the bottom inside of the holder fixing groove; a base holder part that extends in either direction from the housing fixing part, has elasticity, and elastically supports the base; and an inner wall support part located on one or both sides of the base holder part, extending in either direction from the housing fixing part.

On one side of the inner wall support part, a reinforcing bead is formed protruding outward, so as to reinforce the supporting strength of the inner wall support part. The reinforcing bead is formed on the side of the inner wall support part facing the outside of the socket housing; on the inner wall of the receiving space, a bead insertion groove is formed connecting to the holder fixing groove, into which the reinforcing bead is inserted.

A contact terminal is disposed in the receiving space and a stop piece is formed on the outside of the contact terminal and is bent downward and outward, preventing removal of the contact terminal by latching on the catch projection that projects from the inner wall of the receiving space. A wire seal is crimped to the contact terminal and projections are formed on the outer face of the wire seal that compressibly engages the socket housing providing a moisture resistant barrier. On the outside of the socket housing, a gasket is fastened, and the gasket is covered by a lug; a mounting verification projection is formed protruding from the parts of the outer face of the lug that are mounted to and contact the socket housing.

BRIEF DESCRIPTION OF THE DRAWINGS

This application is illustrated by way of example and not limited in the accompanying figures in which like reference numerals indicate similar elements and in which.

DETAILED DESCRIPTION OF THE PREFERRED EMBODIMENTS

Figure 1:
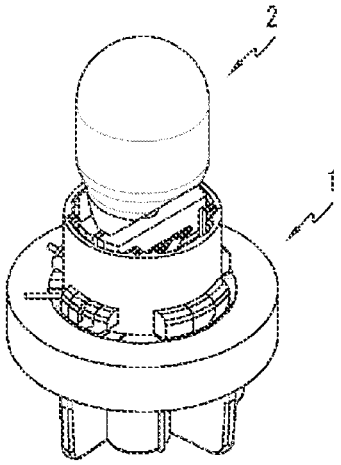
FIG. 1 is an oblique view of a bulb coupled with the lamp socket of the disclosure according to Embodiment 1.

FIGS. 1-12 illustrate an embodiment of the disclosure and it is to be understood that the disclosed embodiment is merely exemplary of the invention, which may be embodied in various forms. Therefore, specific details disclosed herein are not to be interpreted as limiting, but merely as a basis for the claims and as a representative basis for teaching one skilled in the art to variously practice the disclosure.

One or more embodiments of the present disclosure can be used for diverse purposes, and is not limited e.g. to automotive headlights. This lamp socket 1 holds a bulb 2 in place removably in the socket housing 100 formed as a unit with a single mold; a receiving space 110 into which the base 21 of a bulb 2 is inserted is formed in the top part of the socket housing 100. Because the base 21 of the bulb 2 has a rectangular cross-section, it is fixed in place after insertion into the receiving space 110 not by a twisting motion but by a pushing and fastening motion, and is also removed by a pulling motion.

A key 22 for properly inserting the bulb 2 into the socket housing 100 is formed protruding from the base 21 of the bulb 2; as described below, the key 22 may be implemented in diverse ways depending on the model of the bulb 2. A key groove, described below, corresponding to the key 22 of the bulb base 21, is formed in the receiving space 110 of the socket housing 100.

Figure 2:
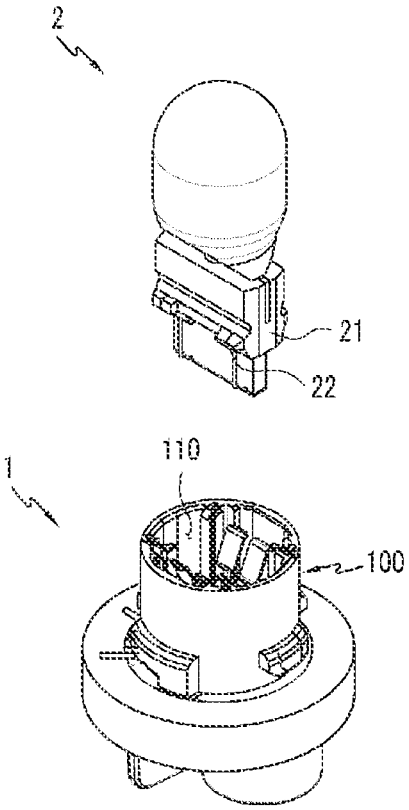
FIG. 2 is an oblique view showing the bulb separated from the lamp socket.
Figure 3:
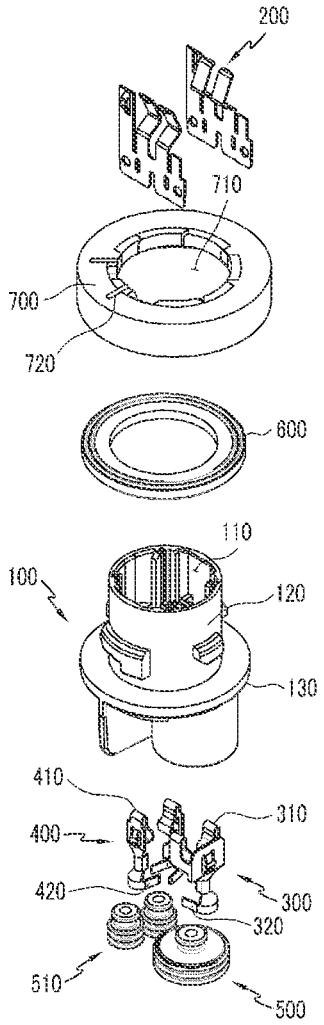
FIG. 3 is an exploded oblique view of the lamp socket shown in FIG. 2.
Figure 4:
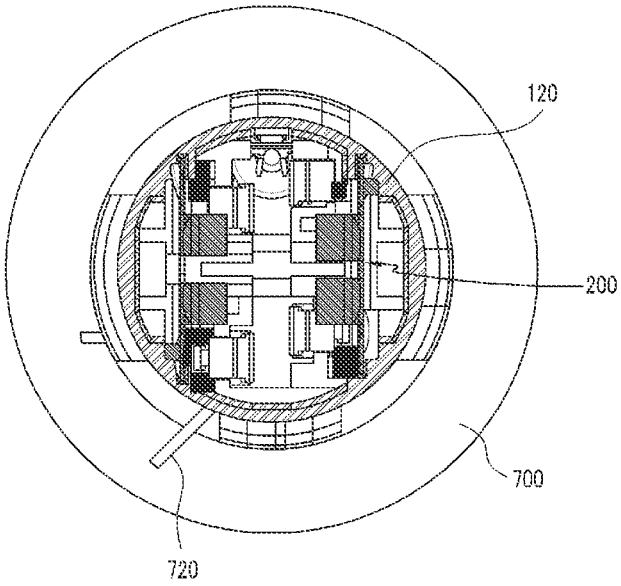
FIG. 4 is a top view of the lamp socket.
Figure 5:
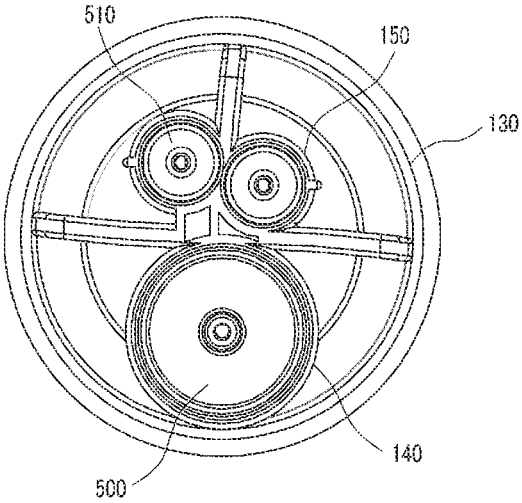
FIG. 5 is a bottom view of the lamp socket.
Figure 6:
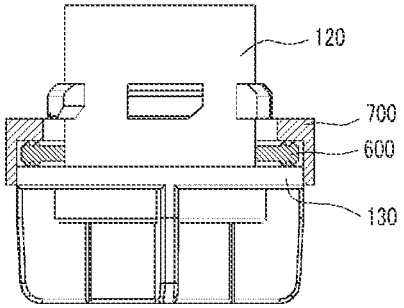
FIG. 6 is a cross-section showing the gasket surrounded by the mounting lug.

FIG. 3 is an exploded oblique view of the lamp socket shown in FIG. 2; FIG. 4 is a top view of the lamp socket; FIG. 5 is a bottom view of the lamp socket; FIG. 6 is a cross-section showing the gasket surrounded by the mounting lug.

The lamp socket 1 comprises a socket housing 100, lamp holder 200, double contact terminal 300, a pair of single contact terminals 400, wire seal 500510, gasket 600 and mounting lug 700.

Inside the top part of the socket housing 100, a receiving space 110 is formed so as to form a cylindrical socket part 120 into which the base 21 of a bulb 2 is inserted; in the center of the socket housing 100, a disc-shaped flange part 130 is formed, and on the bottom of the flange part 130, a seal fixing part 140150 is formed into which the wire seal 500510 is inserted and fixed in place.

The lamp holder 200 is mounted on opposite sides of the inner wall of the receiving space 110 of the socket housing 100, and configured to make flexible contact with the base 21, so that the base 21 of the bulb 2 is fixed in place when inserted into the receiving space 110. This lamp holder 200 is elastic and engages either side of the base 21 of the bulb 2.

With respect to the double contact terminal 300, two contact terminals 310 are furnished in the top part thereof, and a seal connecting part 320 to which the wire seal 500 is connected is formed on the bottom part. The seal connecting part 320 is rounded to a semicircular shape so that after insertion the top part of the wire seal 500 is compressibly fixed in place by pressure so that the wire seal 500 is firmly connected.

With respect to the single contact terminal 400, one contact terminal 410 is furnished in the top part thereof, and a seal connecting part 420 to which the wire seal 510 is connected is formed on the bottom part. The seal connecting part 420 is rounded to a semicircular shape so that after insertion the top part of the wire seal 510 is compressibly fixed in place by pressure so that the wire seal 510 is firmly connected.

The wire seal 500, 510 is intended to fix the wire connecting the double contact terminal 300 and single contact terminal 400 in place; it is connected respectively to the bottom of the double contact terminal 300 and single contact terminal 400. Because the wire seal 500, 510 has a circular cross-section, it is readily coupled to the contact terminals 310, 410, and productivity is increased during assembly due to the lack of directionality.

The gasket 600 is fastened to the exterior of the socket part 120 of the socket housing 100, so that when the lamp socket 1 of this invention is mounted e.g. on an automobile it maintains the seal by adhering closely to the mounting site. This gasket 600 has improved durability and heat resistance due to being fabricated with silicone oil.

The mounting lug 700 is fastened to the socket part 120 so as to cover the gasket 600. On the center of the top surface of the mounting lug 700, a socket through hole 710 is formed passing through the socket part 120. On the top surface of the mounting lug 700, a mounting verification projection 720 is formed protruding outward in the vicinity of the socket through hole 710, so that it can be readily confirmed when the lamp socket has been properly mounted, by a "click" sound being emitted when a bulb has been fully mounted in the lamp socket, e.g. in an automobile.

Figure 7:
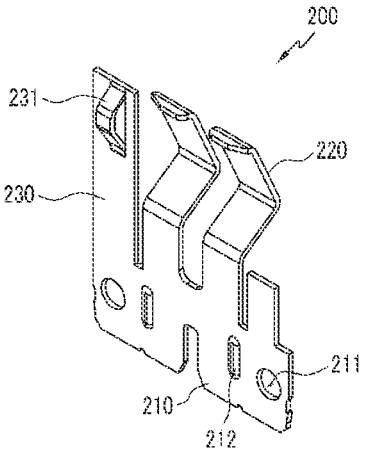
FIG. 7 is an oblique view of the lamp holder.
Figure 8:
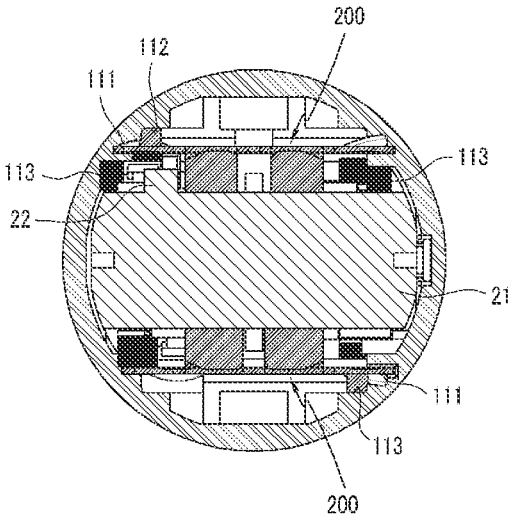
FIG. 8 shows the lamp holder inserted into the socket housing.

FIG. 7 is an oblique view of the lamp holder and FIG. 8 shows the lamp holder inserted into the socket housing. On opposite sides of the interior of the receiving space 110 of the socket housing 100, a holder fixing groove 111 is respectively formed, into which the lamp holder 200 is inserted from top to bottom and fixed in place. At the terminal part of the holder fixing groove 111 on each side, a bead insertion groove 112 is formed into which the reinforcing bead 231, described below, is inserted.

On either side of the inner wall of the receiving space 110 of the socket housing 100, ribs 113 are arranged in a shape corresponding to the key 22 formed on the base 21 of the bulb; on the inside wall of the receiving space 110, a key groove is formed by the arrangement of the ribs 113, into which the key 22 is inserted. By virtue of the arrangement of the ribs 113, only a specific model of bulb having an identical shape of key 22 can be inserted into the receiving space 110. If a model with a different shape of key 22 is inserted, the insertion of the base 21 is prevented because the key 22 catches on the ribs 113.

Due to the lamp holder 200 being configured to flexibly contact the base 21 of the bulb 2 during insertion and fixed into place in the holder fixing groove 111, the base 21 of the bulb 2 is fixed reliably in place within the receiving space 110. This lamp holder 200 comprises a housing fixing part 210 that is fixed to the inside bottom of the holder fixing groove 111, a base holder part 220 that flexibly supports the base 21 of the bulb 2, and an inner wall support part 230 that supports the inner wall of the receiving space 110.

The housing fixing part 210 is formed in a thin flat shape and inserted into the holder fixing groove 111 from above the socket housing 100 and fixed in place. The housing fixing part 210 is fixed in place in the holder fixing groove 111 after being inserted as far as the bottom of the inside of the holder fixing groove 111. The hole 211 and bead 212 formed on either side of the housing fixing part 210 are involved in fixing it into place.

The base holder part 220 is formed from thin-plate structure so as to have elasticity; a pair of base holder parts 220 extends upward from the center of the top of the housing fixing part 210 and is spaced apart from one another. The base holder part 220 adheres to either side of the base 21 of the bulb 2, thereby providing support so that the bulb 2 remains inserted and does not come loose.

The inner wall support part 230 supports the inner wall of the receiving space 110 located in the front of the holder fixing groove 111, by extending upward from one or both sides of the base holder part 220 on the top of the housing fixing part 210 so as to fill the empty space of the holder fixing groove 111. In other words, it prevents the inner wall of the receiving space 110 from being pushed back when the base 21 of a bulb 2 is inserted. In particular, it prevents the insertion of a bulb 2 that does not conform to specifications, by preventing the receiving space 110 from being pushed when the base 21 of a bulb 2 is inserted that does not match or fit the receiving space 110.

As described above, on the inside wall of the receiving space 110, a key groove into which the key 22 of a bulb base 21 is inserted is formed by the arrangement of the ribs 113. By arranging the key groove appropriately to correspond with the position of the key 22 of the base 21, the bulb 2 and socket housing 100 are matched together, and if the bulb 2 and socket housing 100 do not conform to one another's specifications, the insertion of the bulb 2 is prevented.

However, if the inner wall of the receiving space 110 into which the base 21 of the bulb 2 is inserted is pushed outward, there is a risk that a bulb 2 that does not correspond to proper specifications will be inserted into the socket housing 100 and therefore to prevent this, the inner wall support part 230 of the lamp holder 200 is provided. If a bulb 2 that does not meet specifications is in fact inserted without the inner wall of the receiving space 110 being pushed out, it cannot be readily inserted into the socket housing 100, and if inserted by force, the inner wall of the receiving space 110 will be damaged. As a result, the improper combination of bulb 2 with socket housing 100 can be thoroughly prevented.

On one side of the inner wall support part 230, i.e. on the side located toward the outside of the socket housing 100, a reinforcing bead 231 is formed protruding outward, reinforcing the support provided by the inner wall support part 230. The width of either side of the holder fixing part 111 is formed to be wider than the thickness of the inner wall support part 230 and housing fixing part 210, for the purpose of facilitating the insertion of the housing fixing part 210 and inner wall support part 230. Consequently, because there is a risk of the inner wall support part 230 shifting within the holder fixing groove 111, the reinforcing bead 231 serves to prevent shifting of the inner wall support part 230. A bead insertion groove 112 is formed to communicate with the holder insertion groove 111 to facilitate the insertion of the reinforcing bead 231. The reinforcing bead 231 is formed by bending a portion of the inner wall support part 230, or may alternatively be formed separately and then bound to the inner wall support part 230.

Figure 9:
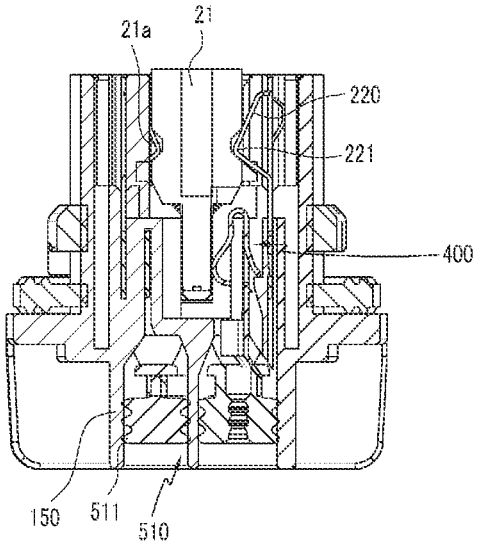
FIG. 9 is a cross-section showing the lamp holder and single contact terminal fixed in place in the socket housing.
Figure 10:
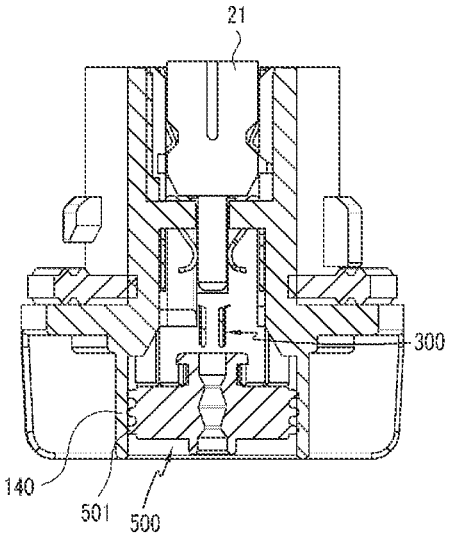
FIG. 10 is a cross-section showing the lamp holder and double contact terminal fixed in place in the socket housing.

FIG. 9 is a cross-section showing the lamp holder and the single contact terminal fixed in place in the socket housing and FIG. 10 is a cross-section showing the lamp holder and the double contact terminal fixed in place in the socket housing. A protruding part 221 is formed in the base holder part 220 of the lamp holder 200, that extends into the receiving space 110 of the socket housing 100; on either side of the base 21 of the bulb 2, a protruding part insertion groove 21*a* is formed into which the protruding part 221 of the lamp holder 200 is inserted. Consequently; if the base 21 of the bulb 2 is inserted completely into the receiving space 110, the bulb 2 is fixed firmly in place in the receiving space 110 by the protruding part 221 of the lamp holder 200 engaging the protruding part insertion groove 21*a* of the base 21.

On the outside of the single contact terminal 400, i.e. on the opposite side of the part that contacts the base 21, a stop piece (not shown) is formed downward and outward at an angle, preventing the detachment of the single contact terminal 400 from the receiving space 110 by latching on the catch projections (not shown) protruding from either side of the receiving space 110.

Each wire seal 500, 510 connected to the double contact terminal 300 and single contact terminal 400 has a circular cross-section; a plurality of ring-shaped sealing projections 501, 511 is formed spaced apart from one another on the outer surface thereof. Due to the sealing projections 501, 511, the wire seals 500, 510 are directly compressibly engaged to the seal fixing parts 140, 150 of the socket housing 100.

FIG. 11 shows diverse combinations of the key formed on the bulb base and the corresponding arrangements of ribs within the receiving space.

As described above, only a specific model of bulb can be fastened into the lamp socket, and other models of bulb are not compatible. In other words, because only a specific company's specific model of bulb can be fastened into a specific bulb socket, product exclusivity in the marketplace can be secured.

Figure 11A:
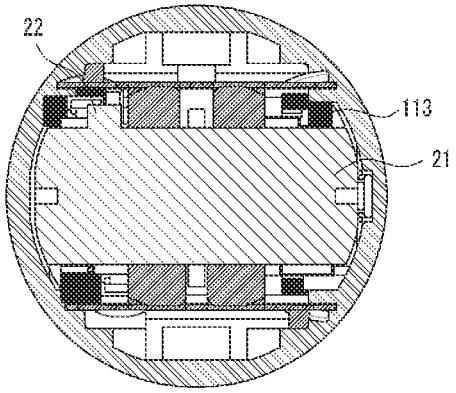
FIG. 11 shows diverse combinations of the key formed on the bulb base and the corresponding arrangements of ribs within the receiving space.
Figure 11B:
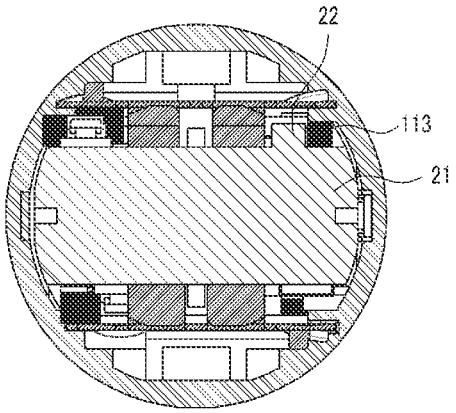

FIGS. 11*a* and 11*b* show a form in which the key 22 is formed projecting from only one side of the base 21; the ribs 113 are arranged within the receiving space 110 to form a matching key groove. Thus, the insertion into the receiving space 110 of bulbs having shapes other than those in FIGS. 11*a* and 11*b* is prevented.

Figure 11C:
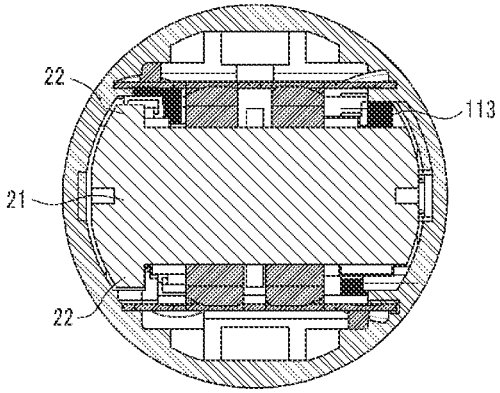
Figure 11D:
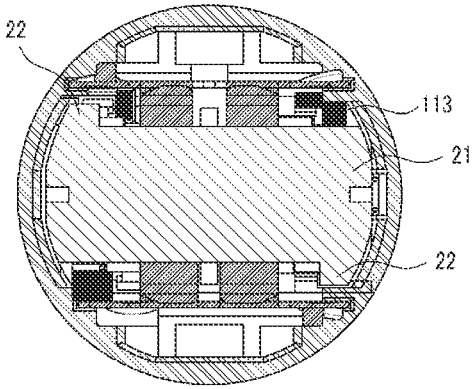
Figure 11E:
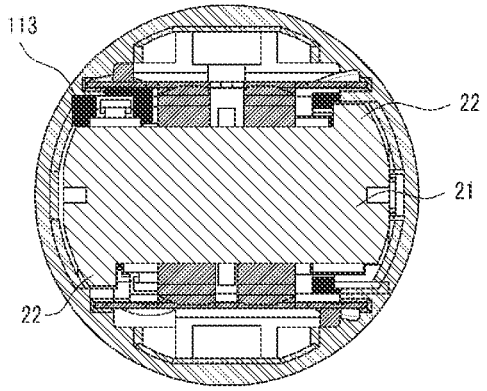
Figure 12A:
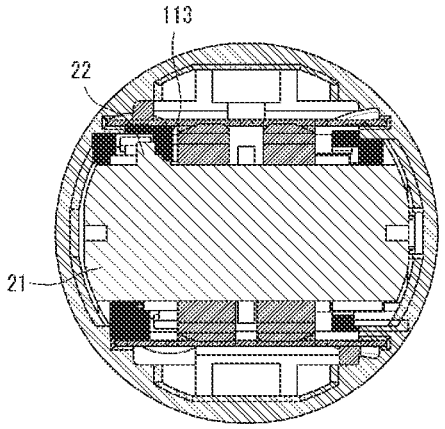
FIG. 12 shows the impossibility of properly inserting the base when the key formed in the base does not match with the arrangement of ribs in the receiving space.
Figure 12B:
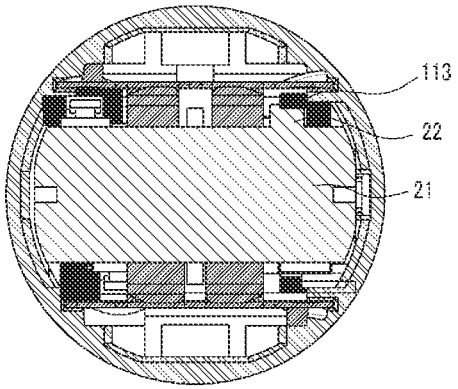
Figure 12C:
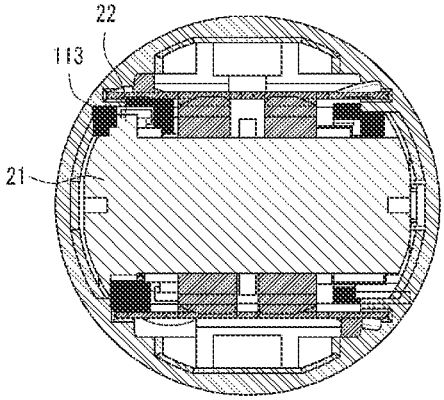
Figure 12D:
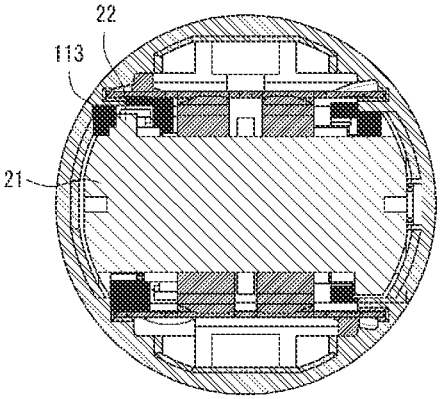
Figure 12E:
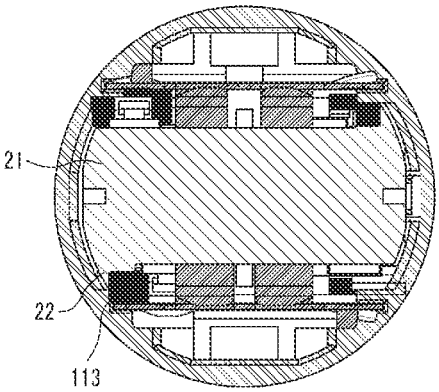

FIGS. 11*c* through 11*e* show a key 22 formed protruding from one location on either side of a base 21. In FIG. 11*c*, keys 22 are formed opposite one another on either side of the base 21; in FIGS. 11*d* and 11*e*, keys 22 are formed offset from one another on either side of the base 21. The ribs 113 are also formed correspondingly within the receiving space 110.

FIG. 12 shows the impossibility of properly inserting the base when the key formed in the base does not match with the arrangement of ribs in the receiving space.

FIGS. 12*a* through 12*e* illustrate situations in which the shape and position of the key 22 formed on the base 21 does not match the arrangement of the ribs 113, so that the base 21 cannot be properly inserted into the receiving space 110. FIGS. 12*a* through 12*e* depict the insertion of a base 21, but this is merely depicted virtually, in order to show the overlap between the key 22 of the base 21 and the ribs 113; in practice, the key 22 of the base 21 will catch on the rib 113 in the overlapping site, preventing insertion.

Hereinabove, the lamp socket of this invention has been described based on a preferred embodiment, but this invention is not limited to any specific embodiment, and a person of ordinary skill in the art of the relevant field will be able to make diverse modifications without departing from the claimed scope of the disclosure.

I claim:

1. A lamp socket comprising:

a housing, the housing having a receiving space, the receiving space having an inner wall, a rib formed on the inner wall and arranged in a pattern on the inner wall of the receiving space, a bulb, the bulb having a base, a key formed on the base;

the key formed on the base does not interfere with the rib arranged in the receiving space when the base of the bulb is inserted into the receiving space of the housing; and wherein an elastic lamp holder is retained on a side wall of the receiving space and comprises: a housing fixing part, an elastic base holder part extending from the housing fixing part and an inner wall support part disposed adjacent to the base holder part and extending from the housing fixing part.

2. The lamp socket according to claim 1, wherein key grooves are formed on the inner wall of the receiving space by the arrangement of the rib.

3. The lamp socket according to claim 2, wherein the key grooves formed by the rib are arranged to match the key formed on a side of the base.

4. The lamp socket according claim 1, wherein the pattern on the inner wall of the receiving space is formed by a plurality of ribs.

5. The lamp socket according to claim 1, wherein the inner wall support part is inserted into fixing grooves formed on a side of the inner wall of the receiving space.

6. The lamp socket according to claim 1, wherein a reinforcing bead is formed on a side of the inner wall support part.

7. The lamp socket according to claim 6, wherein a bead insertion groove is formed in the housing communicating with the holder fixing groove and configured to receive the reinforcing bead formed on the inner wall support part.

8. The lamp socket according to claim 1, wherein a contact terminal is disposed in the receiving space receiving space, the contact terminal includes a stop piece that engages a catch projection projecting from the inner wall of the receiving space.

9. The lamp socket according to claim 8, wherein a wire seal is fixed on the contact terminal and includes a projection formed on the outer face of the wire seal that compressibly engages the socket housing.

10. The lamp socket according claim 1, wherein a gasket is fastened to the socket housing and the gasket is covered by a lug with a mounting verification projection formed protruding from the lug.

11. A lamp socket comprising:

a housing, the housing having a receiving space, the receiving space having an inner wall, a rib formed on the inner wall and arranged in a pattern on the inner wall of the receiving space;

a contact terminal, the contact terminal is disposed in the receiving space;

an elastic lamp holder, the lamp holder is retained on a side wall of the receiving space and includes an elastic base holder, a housing fixing part, an elastic base holder part extending from the housing fixing part and an inner wall support part disposed adjacent to the base holder part extending from the housing; and a bulb, the bulb having a base, a key formed on the base, the key formed on the base does not interfere with the rib arranged in the receiving space when the base of the bulb is inserted into the receiving space of the housing and the elastic base holder engages and retains the bulb in the socket.

12. The lamp socket according to claim 11, wherein key grooves are formed on the inner wall of the receiving space by the arrangement of the rib.

13. The lamp socket according to claim 12, wherein the key grooves formed by the rib are arranged to match the key formed on a side of the base.

14. The lamp socket according claim 11, wherein the pattern on the inner wall of the receiving space is formed by a plurality of ribs.

15. The lamp socket according to claim 11, wherein the inner wall support part is inserted into fixing grooves formed on a side of the inner wall of the receiving space.

16. The lamp socket according to claim 11, wherein a reinforcing bead is formed on a side of the inner wall support part.

17. The lamp socket according to claim 16, wherein a bead insertion groove is formed in the housing communicating with the holder fixing groove and configured to receive the reinforcing bead formed on the inner wall support part.

18. The lamp socket according to claim 11, wherein a wire seal is fixed on the contact terminal and includes a projection formed on the outer face of the wire seal that compressibly engages the socket housing.

19. The lamp socket according claim 11, wherein a gasket is fastened to the socket housing and the gasket is covered by a lug with a mounting verification projection formed protruding from the lug.

20. A lamp socket comprising:

a housing, the housing having a receiving space, the receiving space having an inner wall, a rib formed on the inner wall and arranged in a pattern on the inner wall of the receiving space;

a bulb, the bulb having a base, a key formed on the base;

the key formed on the base does not interfere with the rib arranged in the receiving space upon insertion of the base of the bulb into the receiving space of the housing; and an elastic lamp holder, the lamp holder having a housing fixing part, an elastic base holder part extending from the housing fixing part, an inner wall support part disposed adjacent to the base holder part and extending from the housing fixing part and retained on a side wall of the receiving space.

* * * * *